US008596500B2

(12) United States Patent
Antonetti

(10) Patent No.: US 8,596,500 B2
(45) Date of Patent: Dec. 3, 2013

(54) ANTI-BUBBLING AND ANTI-CONTAMINATION WATER DISPENSER

(76) Inventor: Oscar Anselmo Antonetti, Buenos Aires (AR)

( * ) Notice: Subject to any disclaimer, the term of this patent is extended or adjusted under 35 U.S.C. 154(b) by 171 days.

(21) Appl. No.: 13/159,810

(22) Filed: Jun. 14, 2011

(65) Prior Publication Data

US 2012/0006852 A1 Jan. 12, 2012

(30) Foreign Application Priority Data

Jun. 14, 2010 (AR) ..... M100102100
Jun. 8, 2011 (AR) ..... P110101972

(51) Int. Cl.
*B67D 7/06* (2010.01)

(52) U.S. Cl.
USPC ..... 222/185.1; 222/80; 222/481.5

(58) Field of Classification Search
USPC ..... 222/80, 185.1, 481, 481.5, 146.6; 141/319, 320, 329, 363, 364
See application file for complete search history.

(56) References Cited

U.S. PATENT DOCUMENTS 948,883 A * 2/1910 Hughes ..... 222/185.1
1,319,376 A * 10/1919 Cooper ..... 222/185.1
1,834,672 A * 12/1931 Austin ..... 222/185.1
2,056,863 A * 10/1936 Napier ..... 222/185.1
4,646,944 A * 3/1987 Sanderson ..... 222/108
5,003,790 A * 4/1991 Goupil ..... 62/389
5,213,597 A * 5/1993 Campbell ..... 222/185.1
5,259,534 A * 11/1993 Lynd ..... 222/81
5,785,459 A * 7/1998 Swinimer ..... 405/237
5,819,994 A * 10/1998 Leipold ..... 222/541.9
6,892,903 B1 * 5/2005 Bartolotta ..... 222/185.1
2002/0162856 A1 * 11/2002 Sheridan et al. ..... 222/129

* cited by examiner

*Primary Examiner* — Kevin P Shaver
*Assistant Examiner* — Patrick M Buechner
(74) *Attorney, Agent, or Firm* — Young & Thompson

(57) ABSTRACT

An anti-bubbling and anti-contamination water dispenser of the kind used to dispense water from disposable bottles which have a threaded cap, including a hexahedral housing to support the disposable bottles, having on the upper wall a container; the container is communicated with a tap to dispense water disposed perpendicular to the front wall of the housing to support the disposable bottles; wherein the front wall of the support housing of the disposable bottles has a recess that allows a gap between the tap outlet and the projection of the front wall wherein a glass for beverages aligned with the outlet center of water from the tap can fit, wherein the upper container has an identical inner diameter and threading that the cap of the disposable bottle.

10 Claims, 16 Drawing Sheets

Bottle opening

Minor Base

Hollow truncated cone with equally sloped steps

Upper view of hollow truncated cone with 3 steps

Major Base

ANTI-BUBBLING AND ANTI-CONTAMINATION WATER DISPENSER

FIELD OF THE INVENTION

The present anti-bubbling and anti-contamination water dispenser according to this description, refers to a water dispenser of the kind used to dispense water from disposable bottles which have a threaded cap, comprising a hexahedral housing to support said disposable bottles, having on the upper wall a container; said container is communicated with a tap to dispense water, wherein said front wall of the housing to support said disposable bottles has a recess that allows a gap between the tap outlet and the projection of said front wall wherein a glass for beverages aligned with the outlet center of water from the tap can fit, wherein said upper container has an identical inner diameter and threading that the cap of the disposable bottle.

The object of the present water dispenser is to provide the present drinking water disposable bottles with threaded cap a suitable device that allows reducing contamination of the same by water contact with air preventing bubbling of air inside the bottle.

Another object of this invention refers to an anti-bubbling and anti-contamination water dispenser of the kind used to dispense water from bottles, disposable or non-disposable, which have a threaded cap or not, comprising a hexahedral housing to support said bottles, having on the upper wall a hollow truncated cone that raises from said upper wall of the housing, said hollow truncated cone has a slope that decreases to the upper minor base of the hollow truncated cone, said hollow truncated cone is joined to the housing through this bottom major base, said hollow truncated cone can have steps which slope also decreases to the upper end configuring the minor base of said truncated cone; said hollow truncated cone is communicated with a tap through the major base disposed on the upper wall of the housing to dispense water, wherein the front wall of the housing to support said disposable or non disposable bottles, has a recess that allows a gap between the tap outlet and the projection of said front wall wherein a glass for beverages aligned with the outlet center of water from the tap can fit, wherein said hollow cone has on the upper truncated side a smaller diameter than the inner diameter of the opening of disposable bottles of 5, 6 or 8 liters or the opening of bottles that have no threading as is generally the case of 20 liters bottles.

The object of this second embodiment of the dispenser is to provide the present bottles of drinking water in the market, disposable or non-disposable, with threaded cap or not, a suitable dispenser allowing to reduce contamination of the same by water contact with air preventing bubbling of air inside the bottle and by means of the hollow cone included that the dispenser is adaptable to any kind of bottle.

STATE OF THE ART

At present there are available in the market drinking water dispensers used at home or offices that use replaceable bottles that can be disposable or non-disposable containing drinking water.

These dispensers may have refrigerating or heating circuits to obtain drinking water according to the desired use.

All these dispensers have containers generally large in comparison with the bottle opening and neck to prevent water splashing when the bottle is loaded.

On these dispensers of the prior art bubbling of air through the fluid contaminates the water contained inside the bottle; said contamination is considered active as explained hereinafter.

U.S. Pat. No. 5,687,865 shows water dispensers for replaceable bottles wherein the bottle is placed within a reservoir wherein a probe pushes a cap used in this kind of bottles that allows water flow through the circuit to the corresponding taps.

U.S. Pat. No. 5,370,270 also shows the same system wherein different types of bottle caps and probes of the water dispensers are discussed.

U.S. Pat. No. 5,647,416 shows a water dispenser with a water reservoir before the tap.

Frequently, these systems used in the office or at home are not operated continuously, especially during the weekends or vacations; all these dispensers have a relatively large reservoir comparing to the opening of the bottle wherein water is stored before getting to the tap; the bottles are turned over said receptacle to prepare the system to dispense water; in the case of these dispensers the size of the receptacle must be large to compensate the inner pressure of the bottle with the atmospheric pressure so that water enters into the bottle by means of bubbles that are observed through the clear wall of these types of bottles, so that water can flow by the system to the tap. This type of systems have the drawback that the water surface has great contact with the atmospheric air and therefore in places with a lot of dust, dirt or even microorganisms contamination via said receptacle is very high and will get into the bottle by the bubbles when pressures are compensated; dirt contained in the air will wash in the bottle water when bubbles go through; also it has to be considered the time the system is not operated which enables incubation and replication of microorganisms that in this way get into said water.

This kind of dirt cleaning by means of water that in the case of water dispensers corresponds to active contamination, is used by industrial or home dust aspiration systems (vacuum cleaners) comprising a filter with water to retain dust, wherein water acts as a purifier of dirt making the particles to decant in reservoirs adapted to that purpose; even advertising brochures of these devices read "cleans your house and the air at the same time".

Publication AR064691A1 shows a system without contamination wherein a membrane or floating device that avoids the contact liquid-air is interposed.

All these systems use conventional taps known in the art.

At present, disposable or non disposable bottles, of 5, 6, 8 and 20 liters with threaded cap or not, are commercialized, where the 20 liter bottle generally is not threaded and has a plug plus another smaller plug that is pushed into the bottle when a probe of present dispensers of fluid introduces it when is positioned to be used.

Abstract

A way to avoid contamination that leads to a better use of the water dispensers for disposable bottles with threaded cap, comprises to reduce in size and for containers used in the prior art systems to the size of the threaded cap of the bottle; these disposable bottles can be threaded in said receptacles producing a leakage proof joint like the bottle cap itself and then, once installed, by means of a small puncture in the bottle they let the air necessary so that water flows by the dispenser pipeline in, preventing bubbling of air passing through the water contained in the bottle.

It should be understood that said puncture can be of a so small size to ensure the minimum contamination considering that contamination increases as its section increases as it enables a higher chance of access of particles suspended in the atmosphere.

This invention provides an anti-bubbling and anti-contamination water dispenser of the kind used to dispense water from disposable bottles, which have a threaded cap, comprising a hexahedral housing to support said disposable bottles, having on the upper wall a container; said container is communicated with a tap to dispense water disposed perpendicular to the front wall of the housing to support said disposable bottles; wherein said front wall of the support housing of said disposable bottles has a recess that allows a gap between the tap outlet and the projection of said front wall wherein a glass for beverages aligned with the outlet center of water from the tap can fit, wherein said upper container has an identical inner diameter and threading that the cap of the disposable bottle.

The recessed zone in the front wall allows an easy access of the glass under the tap fill it with water from the bottle.

In this kind of anti-bubbling and anti-contamination water dispenser of the kind used to dispense water from disposable bottles, which have a threaded cap, comprising a hexahedral housing to support said disposable bottles, having on the upper wall a container as previously described, said container can be communicated with the tap by a central opening by means of a water circulation circuit comprising an initial vertical section and a 90° elbow that allows connection to said tap by means of a horizontal section connected to said tap.

A feature of said container is that it can also be communicated with the tap by a side opening; that is the initial section comprises the container.

In the present anti-bubbling and anti-contamination water dispenser, the hexahedral housing to support said disposable bottles can seat on any planar surface by means of the four side walls comprising the same.

Furthermore, said support hexahedral housing can be hollow inside.

The side walls of the hexahedral housing to support said disposable bottles can be curved as necessary to obtain a lighter object.

Another characteristic the housing may have is that the base of the hexahedral housing to support said disposable bottles can have a larger area than the upper wall containing container that has an identical inner diameter and threading that the cap of the disposable bottle; this determines a larger support base to better hold the bottle.

It has been empirically determined that the water outlet height of the water tap conveniently is at a height of about 1.5 times or more the height of a glass for common beverages measured from the base; so that said glass can be placed or removed easily when it is filled with the water from the tap.

The upper container that has an identical inner diameter and threading that the cap of the disposable bottle can project from the upper wall for a better threading of the bottle during use.

The upper container can have a lid to prevent dirt from depositing on the same when no bottle is placed.

Plastic type materials that can be injected are preferred, such as polyethylene, PVC, polypropylene or others; the use of a light plastic material that can be injected allows obtaining an article suitable for handling.

In this water dispenser, the container, the initial section, the 90° elbow and the horizontal section can be made in a single piece of the same material or a different material that the housing.

Conveniently the upper container that has an identical inner diameter and threading that the cap of the disposable bottle also has an inner edge concentric with the circumference where the disposable bottle is threaded, which is separated from the side wall by a distance equal to a thickness taken from the inner wall of the bottle to the zone of the threading of the disposable bottle, and a height equal to the distance taken from the last thread of the bottle to the final edge of the disposable bottle neck; this inner wall makes a tight seal between the lower portion of the threaded bottom wall of the bottle and the container thread.

Another better use of this water dispenser comprises to prepare the whole system to obtain water through a tap; generally disposable bottles with threaded cap of 5, 6 and liters previously opened shall be inverted on the containers producing the spilling of water that rebounds on the reservoir walls; the method to install bottles of the present water dispenser is free from said drawback as it is executed in the following way:

i) to open the disposable bottle;

ii) to invert the dispenser and adjust it to the bottle threading by means of the upper container that has an identical inner diameter and threading that the cap of the disposable bottle;

iii) to invert the bottle dispenser assembly so that it is supported by the dispenser base;

iv) to puncture with a sharp object the upper portion of the assembly (base of the disposable bottle) so that passage of air is allowed in order that water flows freely through the tap when this is open preventing bubbling through the water contained in the bottle.

That is, the housing is threaded on the bottle preventing leaks and then the whole inverted assembly seating on the base is ready to dispense water through the tap before boring the bottle wall.

In this water dispenser, when air enters via the drilled orifice, initially the particles contained by said air, are first suspended inside the air chamber of the bottle and then will decant on the water but without penetrating due to the surface tension of the water that prevents so.

Another embodiment of the dispenser uses a hollow truncated cone that raises from the upper wall of the housing, in this way contamination is also prevented leading to a better use of the water dispenser for disposable or non disposable bottles, with threaded cap or not; this comprises to reduce in size and shape the containers used in the systems of the prior art by means of a hollow truncated cone, this can be attained using a hollow truncated cone positioned on a hexahedral housing to support said disposable bottles, said housing has on the upper wall said hollow truncated cone which raises from said upper wall of the housing, said hollow truncated cone has a slope that decreases to the upper base of the truncated cone that corresponds to the minor base of said hollow truncated cone, said hollow truncated cone can have steps which slope also decreases to the upper end than configures said minor base of said hollow truncated cone; said hollow truncated cone is communicated with a tap through the major base disposed on the upper wall of the hexahedral housing to dispense water, said hollow truncated cone has a slope that decreases to the upper portion and that can be a stepped slope to adjust to different sizes of bottle openings of the market including 20 liter non disposable bottles, a slope of 1 degree is suitable to adapt to the different bottles of the market; the bottles, either disposable or non-disposable bottles, can be inserted through their openings in the upper side of the hollow truncated cone, that corresponds to the minor base of the same, producing a leak-proof joint by the weight of the full bottle that makes the inner wall of the neck of said bottle adjust over the outer wall of the hollow cone allowing that water flows to the tap, once the bottle is installed; by means of a small puncture in the bottle the air necessary so that water flows through the dispenser pipeline enters, preventing bubbling of air through the water contained inside the bottle.

It should be considered that said puncture can be made in such a small size to ensure a minimum contamination as the contamination increases when the section of said hole increases, as the chance of entry of particles in suspension in the atmosphere close to the said opening rises.

The present device also refers to an anti-bubbling and anti-contamination water dispenser adaptable to any type of disposable or non disposable bottles, which have a threaded cap or not, comprising a hexahedral housing to support said disposable bottles, that has a hollow truncated cone disposed on the upper wall of the housing; said hollow truncated cone is communicated with a tap through this major base of the cone to dispense water, said tap is perpendicular to the front wall of the housing to support said bottles, either disposable or non-disposable bottles; wherein said front wall of the support housing of said bottles, either disposable or non-disposable bottles, has a recess that allows a gap between the tap outlet and the projection of said front wall wherein a glass for beverages aligned with the outlet center of water from the tap can fit, wherein said upper hollow truncated cone has smaller diameter on its upper base that the inner diameter of the opening of the disposable bottle or inner diameter of the opening of non-disposable bottles as is the general case of 20 liter bottles, wherein the major base of the hollow truncated cone has a larger diameter that the inner diameter of said disposable or non disposable bottles such that the slope configured in the hollow truncated cone on the wall joining the major base to the minor base makes the bottle opening engages to the outer wall of said cone adjusting on the same by the full bottle weight and avoiding fluid leaks.

The recessed zone in the front wall allows an easy access of the glass under the tap to fill it with water from the bottle.

In this type of anti-bubbling and anti-contamination water dispenser of the kind used to dispense water from disposable or non disposable bottles, which have a threaded cap or not, comprising a hexahedral housing to support said disposable bottles, having on the upper wall a hollow truncated cone that can have steps and which slope decreases to the upper end configuring the minor base of said truncated cone; said hollow truncated cone is communicated with a tap through the major base to dispense water by a central opening connected to a water circulation circuit comprising an initial vertical section and a 90° elbow allowing to connect it by means of a horizontal section to said tap.

A feature of said hollow cone is that the initial section can have an identical inner diameter that the inner diameter of the recess in the major base of said hollow truncated cone and also said initial section can be communicated with the tap by a side opening.

In the present anti-bubbling and anti-contamination water dispenser for bottles, either disposable or non-disposable bottles, the hexahedral housing to support said bottles, either disposable or non-disposable bottles, can seat on any planar surface by means of the four side walls comprising the same.

Furthermore, said hexahedral support housing may be is hollow inside.

The side walls of the hexahedral housing to support said disposable bottles can be curved as necessary to obtain a lighter object.

Another feature the housing may have is that the base of the hexahedral housing to support said disposable bottles can have a larger area than the upper side of said housing where the hollow truncated cone is disposed, wherein in said upper side the hollow truncated cone can have steps which slope decreases to the upper end configuring the minor base of said truncated cone; said hollow truncated cone is communicated with a tap through the major base to dispense water; this determines that the opening of the bottle engages in the wall of the hollow truncated cone preventing leaks of the fluid contained inside the bottle.

It has been empirically determined that the water outlet height of the water tap conveniently is about 1.5 times or more of the height of a glass for common beverages measured from the base; so that said glass can be positioned and removed when filling with water of the tap.

The minor base diameter of the hollow truncated cone in the upper portion is smaller than the inner diameter of the opening of the bottle, either disposable or not.

The hollow truncated cone may have on its upper minor base a cap or plug to prevent dirt from depositing in the same when there is no bottle installed.

Plastic type materials that can be injected are preferred, such as polyethylene, PVC, polypropylene or others; the use of a light plastic material that can be injected allows obtaining an article suitable for handling.

In this water dispenser, the hollow truncated cone, the initial section, the 90° elbow and the horizontal section can be made in a single piece of the same material or a different material that the housing.

Conveniently the outer diameter of the upper minor base of the hollow truncated cone has a smaller outer diameter than the inner diameter of the opening of the disposable bottle or non-disposable bottle, so that a seal forms between the inner wall of the bottle and the outer wall of the truncated cone when the bottle with fluid is disposed on the latter.

Another better use of this water dispenser with hollow truncated cone comprises to configure the whole system to obtain water through the tap; generally disposable or non disposable bottles with threaded cap or not of 5, 6, 8 and 20 liters previously opened had to be inverted on the containers of dispensers of the prior art, producing the spilling of water that rebounds on the reservoir walls; the method to install bottles of the present device is free from said drawback as it is executed in the following way:

i) to open the bottle;

ii) to invert the dispenser and introduce the minor base of the hollow truncated cone in the opening of the bottle, adjusting the inner wall of the bottle neck against the outer side of the hollow truncated cone;

iii) to invert the bottle dispenser assembly, keeping the assembly joined during a time enough to seat it on the surface of the place wherein it is installed, so that the assembly is supported by the dispenser base seating on the surface of the place wherein it is installed;

iv) to puncture with a sharp object the upper portion of the assembly (for example the base of the bottle) so that passage of air is allowed in order that water flows freely through the tap when this is open preventing bubbling through the water contained in the bottle.

That is, the opening of the bottle fixes and attaches to the outer wall of the truncated cone preventing leaks and then the complete assembly is inverted and seated on the base being ready to dispense water through the tap once the bottle wall is pierced.

The system can use any type of bottle including, if necessary, bottle with non-rigid walls that are able to deform as the fluid contained is discharged and therefore there is no need to pierce the same to compensate the inner pressure with the atmospheric pressure (zero contamination in this case).

In this dispenser when it is necessary to pierce the bottle to use, when air enters through said orifice, initially the particles contained by said air, are first suspended inside the air chamber of the bottle and then will decant on the water but without penetrating due to the surface tension of the water that prevents so.

DESCRIPTION OF THE DRAWINGS

FIG. 11 shows a front view of an anti-bubbling and anti-contamination water dispenser wherein the hollow truncated cone projects from the upper wall of the hexahedral housing, wherein said hollow truncated cone is communicated with the tap by means of an orifice on the major base, through an initial section and a 90° elbow. It can be seen a glass and the distance to the tap.

FIG. 12 shows a front, side, bottom and upper view of an anti-bubbling and anti-contamination water dispenser with the hollow truncated cone in the upper wall of the housing.

FIG. 13 shows an upper view of the dispenser of the previous figure wherein the features of the same are detailed with a glass disposed under the tap.

FIG. 14 shows al hollow truncated cone wherein the orifice of the initial section has a diameter equal to the inner diameter of the bottom base of the cone wherein the communication with the tap of the initial section is through a side connection to the tap.

FIG. 15 shows a front, upper and perspective view with the bottle of an anti-bubbling and anti-contamination water dispenser with hollow truncated cone wherein the side walls of the housing are curved.

FIG. 16 shows an opening of bottle in this case a threaded opening and the hollow truncated cone with steps; it is shown that the minor base of the hollow truncated cone is smaller than the inner diameter of the opening of the bottle. Considering this drawing, the opening of the bottle will attach to the second step of the truncated cone; it is also shown an upper view of a hollow truncated cone with three steps.

DETAILED DESCRIPTION OF THE INVENTION

Figure 1:
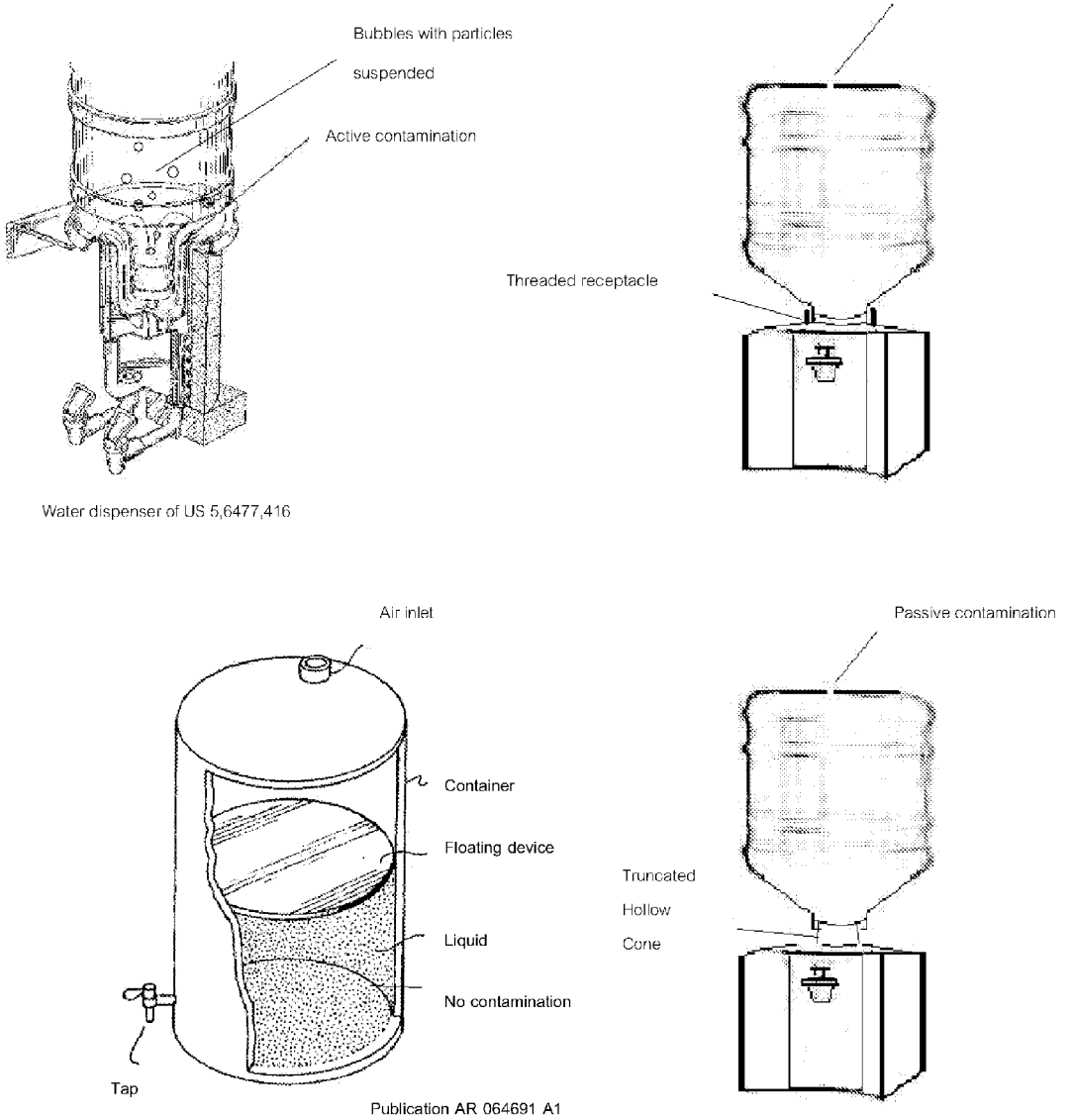
FIG. 1 shows a comparison of the water dispenser of U.S. Pat. No. 5,647,416 to the present water dispenser according to its two embodiments with a threaded receptacle and hollow truncated cone, wherein it is observed the larger surface prone to contamination present in containers of the prior art dispensers, besides the corresponding bubbling through the water contained inside the bottle when discharged from taps; when air gets into the liquid, it retains the suspended particles which are ingested by the user. The type of contamination of prior art devices can be considered as "active" while in the case of the present water dispenser "passive" wherein the area through which said dust enters into the bottle is as small as the size of the puncture pierced in the same. Said figure also shows a device free of contamination according to the publication AR064691A1 wherein a membrane prevents the contact of air with the liquid.
Figure 2:
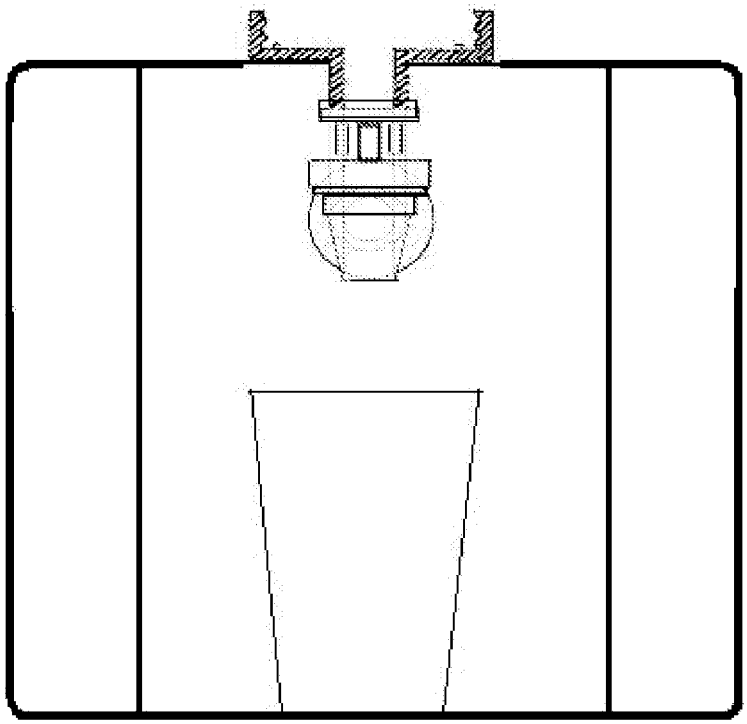
FIG. 2 shows a front view of an anti-bubbling and anti-contamination water dispenser wherein the threaded receptacle or upper container projects from the upper wall of the housing wherein it is observed a glass and the distance to the tap.

FIG. 2 shows a front view of a dispenser according to the invention with a glass disposed under the tap in the recessed zone of the front wall at a distance to the ground approximately equal to 1.5 times the glass height; in this dispenser corresponding to a threaded receptacle its support projects from the upper side of the housing.

Figure 3:
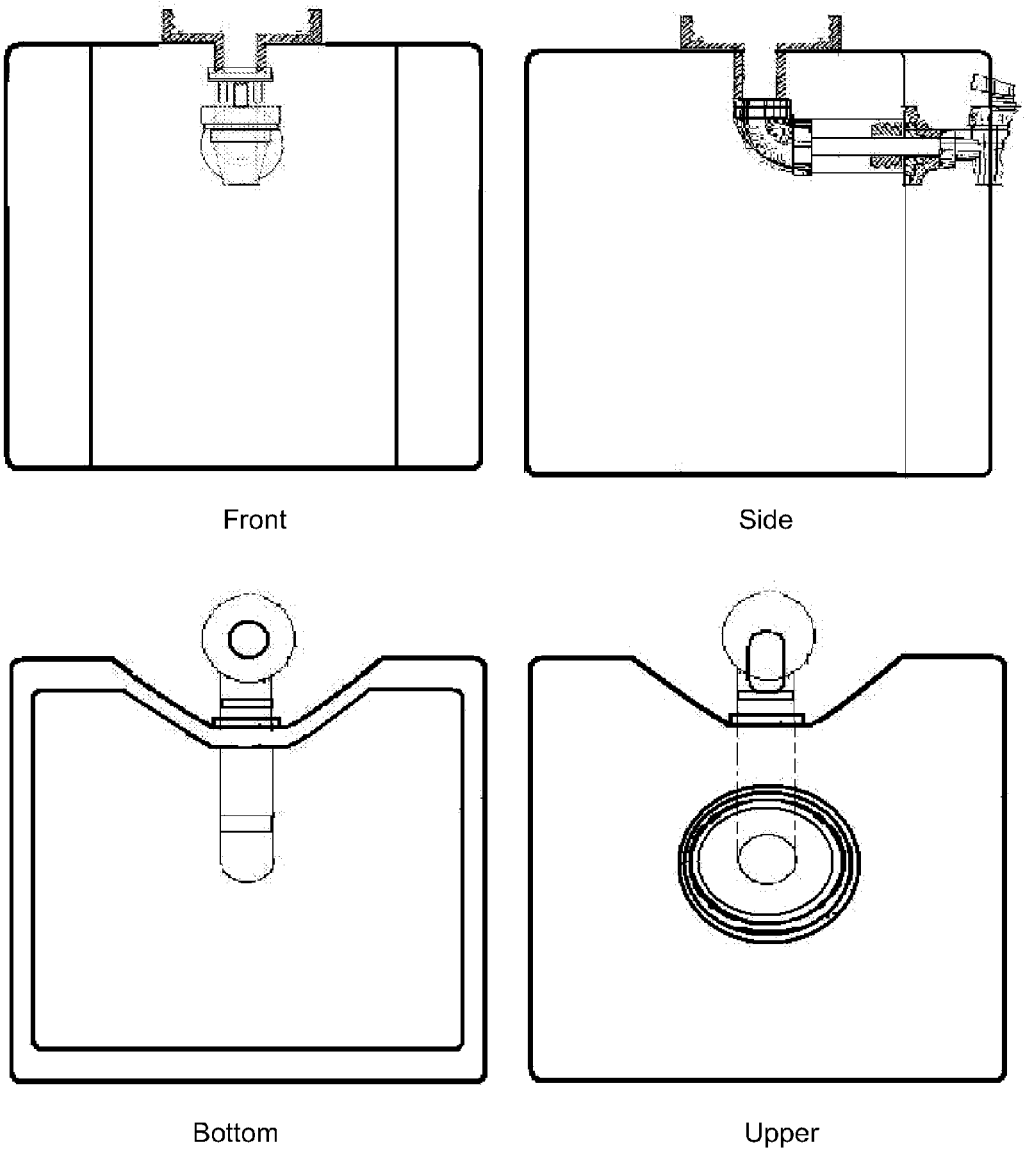
FIG. 3 shows a front, side, bottom and upper view of an anti-bubbling and anti-contamination water dispenser with threaded receptacle.

FIG. 3 shows a front, side, bottom, and upper view of the previous dispenser; in the side view the connection through a horizontal section of the support with a 90° elbow connected the tap can be observed. The bottom view allows to determine that this is a hollow housing supported on the ground by the side walls thereof.

Figure 4:
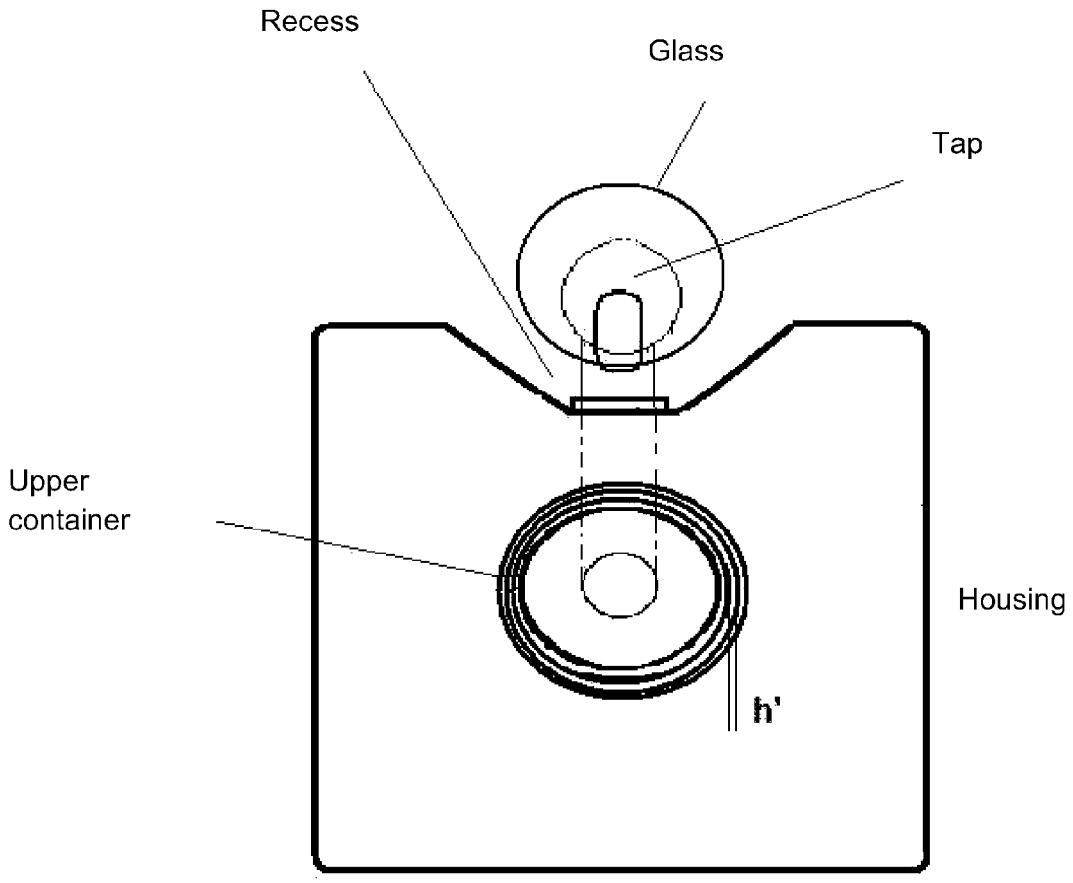
FIG. 4 shows an upper view of the dispenser of the previous figure with threaded receptacle wherein features of the same are detailed, with a glass disposed under the tap.

FIG. 4 shows an upper view of the water dispenser of the previous figure wherein it is shown a glass disposed under the tap and the distance h' between the container threading and the circular inner wall concentric with the outer wall of said container.

Figure 5:
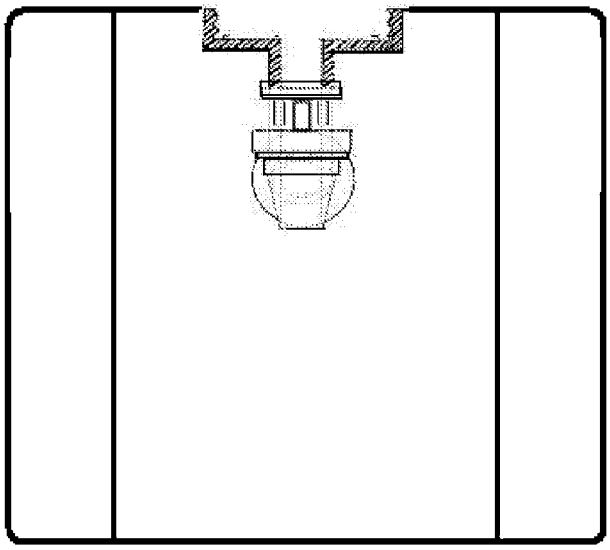
FIG. 5 shows a front view and a perspective view with the bottle of the anti-bubbling and anti-contamination water dispenser wherein the threaded receptacle or upper container does not project from the upper wall.
Figure 5:
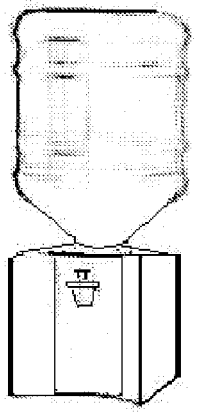

FIG. 5 shows a front view of the anti-bubbling and anti-contamination water dispenser wherein the threaded container does not project from the upper wall; it also shows a perspective view of the same with a bottle attached to the container thread.

Figure 6:
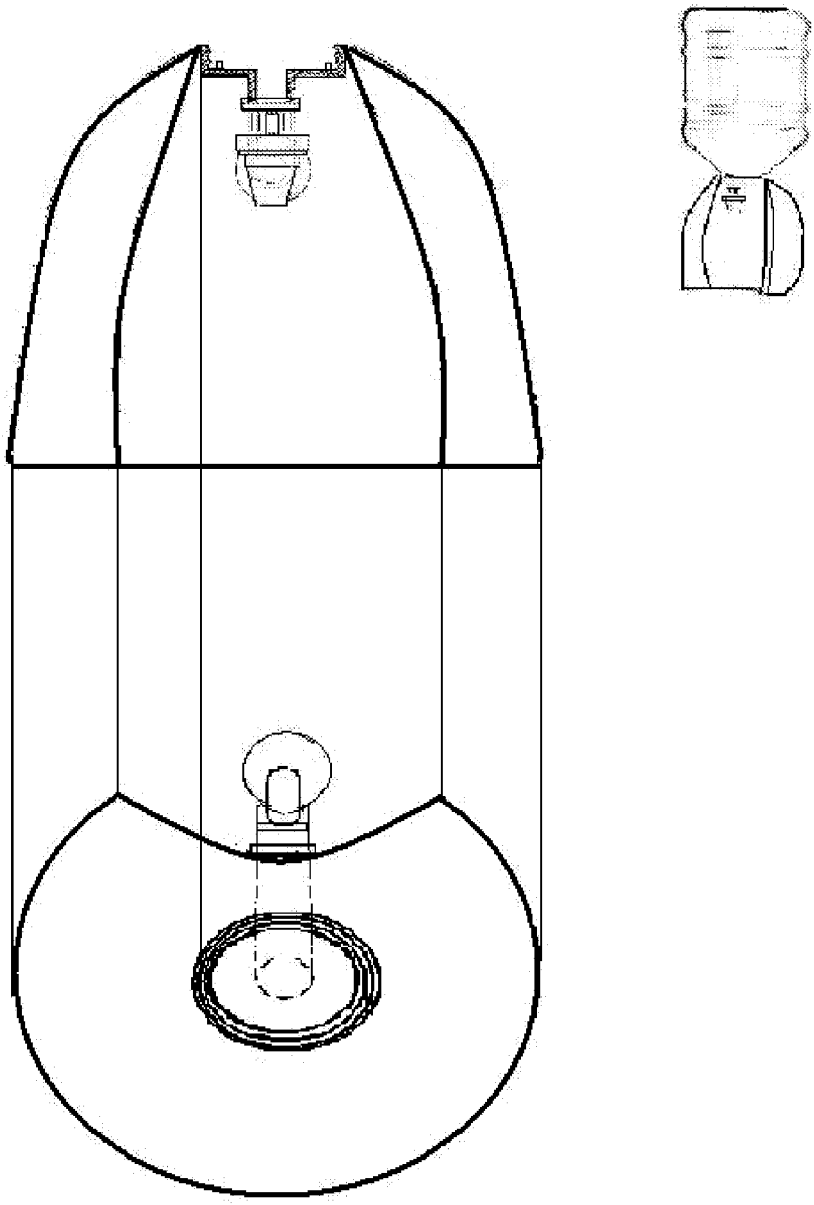
FIG. 6 shows a front, upper and perspective view with the bottle of an anti-bubbling and anti-contamination water dispenser with curved side walls wherein the threaded receptacle or upper container does not project from the upper wall.

FIG. 6 shows a front and upper view of an anti-bubbling and anti-contamination water dispenser wherein the side walls are so curved that the dispenser has a circular shape if it wasn't by the recess wherein the tap is disposed; in this case the threaded receptacle or upper container is included in the upper wall that is smaller than the support surface of the housing, also it is shown a perspective view with the bottle attached to the container thread.

Figure 7:
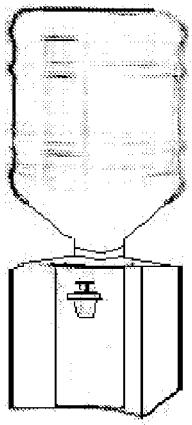
FIG. 7 shows a front view and perspective view with the bottle of the anti-bubbling and anti-contamination water dispenser of FIG. 3.
Figure 7:
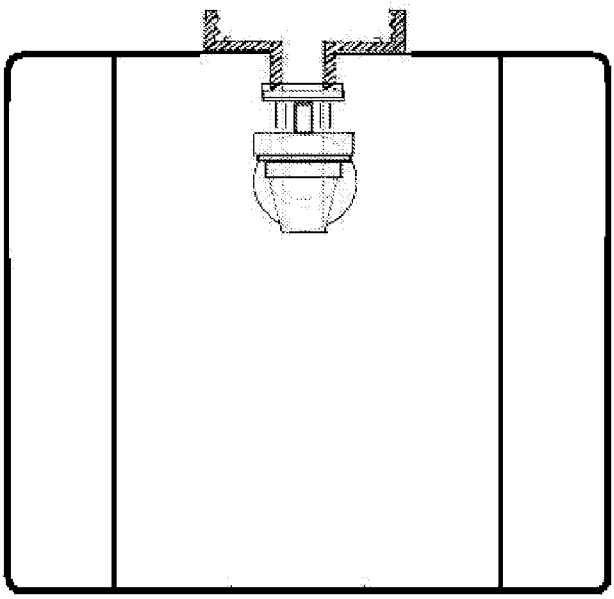

FIG. 7 shows an anti-bubbling and anti-contamination water hexahedral dispenser with planar walls with the threaded receptacle or upper container disposed above the upper side and a perspective view with the bottle attached to the container thread.

Figure 8:
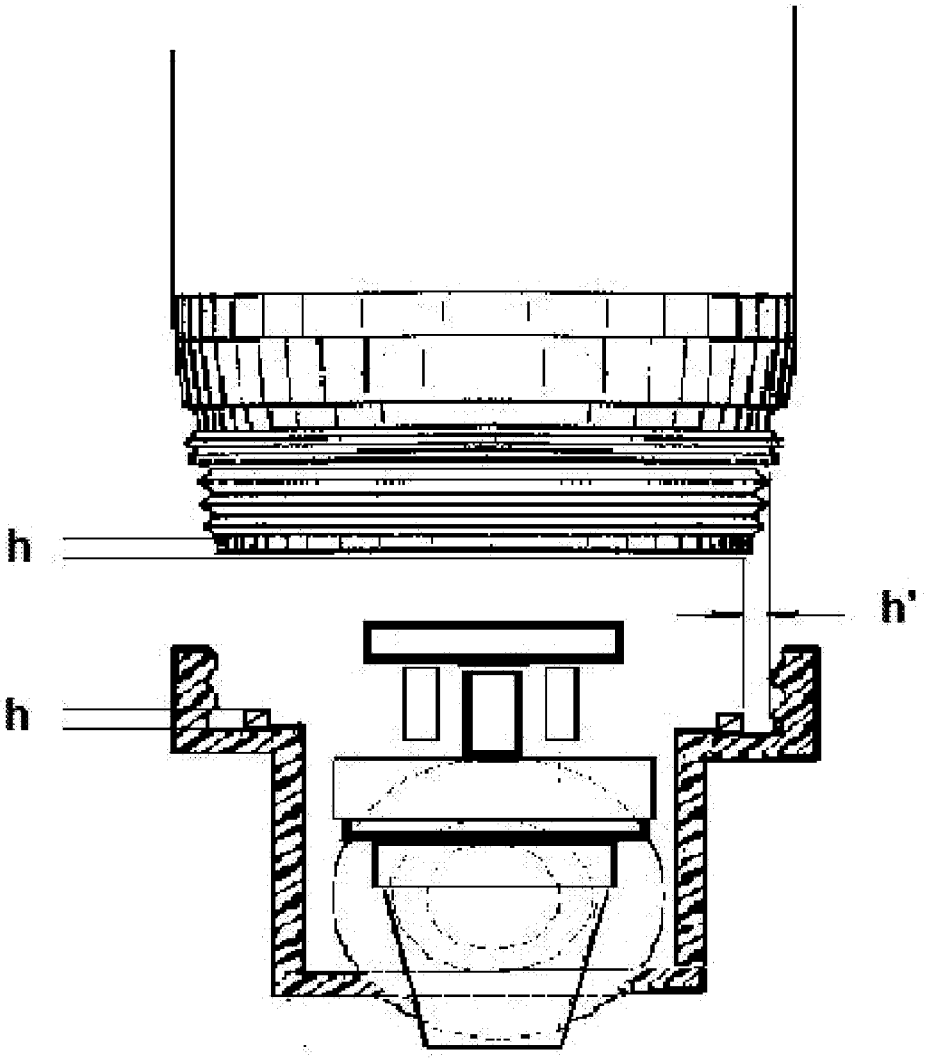
FIG. 8 shows a front view of the threaded receptacle or upper container with side connection to the tap and the opening of the bottle.

FIG. 8 shows a threaded bottle neck and the threaded receptacle or upper container of the anti-bubbling and anti-contamination water dispenser; also the distances h and h' are shown. One corresponds to the height of the inner edge (h) and the other corresponds to the distance between the inner edge and the threading of the receptacle or upper container (h').

Being the inner edge concentric with the circumference where the disposable bottle is threaded, which is separated from the side wall through a distance (h') equal to a thickness taken from the inner wall of the bottle to the zone of the threading of the disposable bottle, and a height (h) equal to the distance taken from the last thread of the bottle to the final edge of the disposable bottle neck; this inner wall configures a tight seal between the lower portion of the threaded bottom wall of the bottle and the container thread. In this case the tap communicates with the threaded receptacle or upper container through a side opening.

Figure 9:
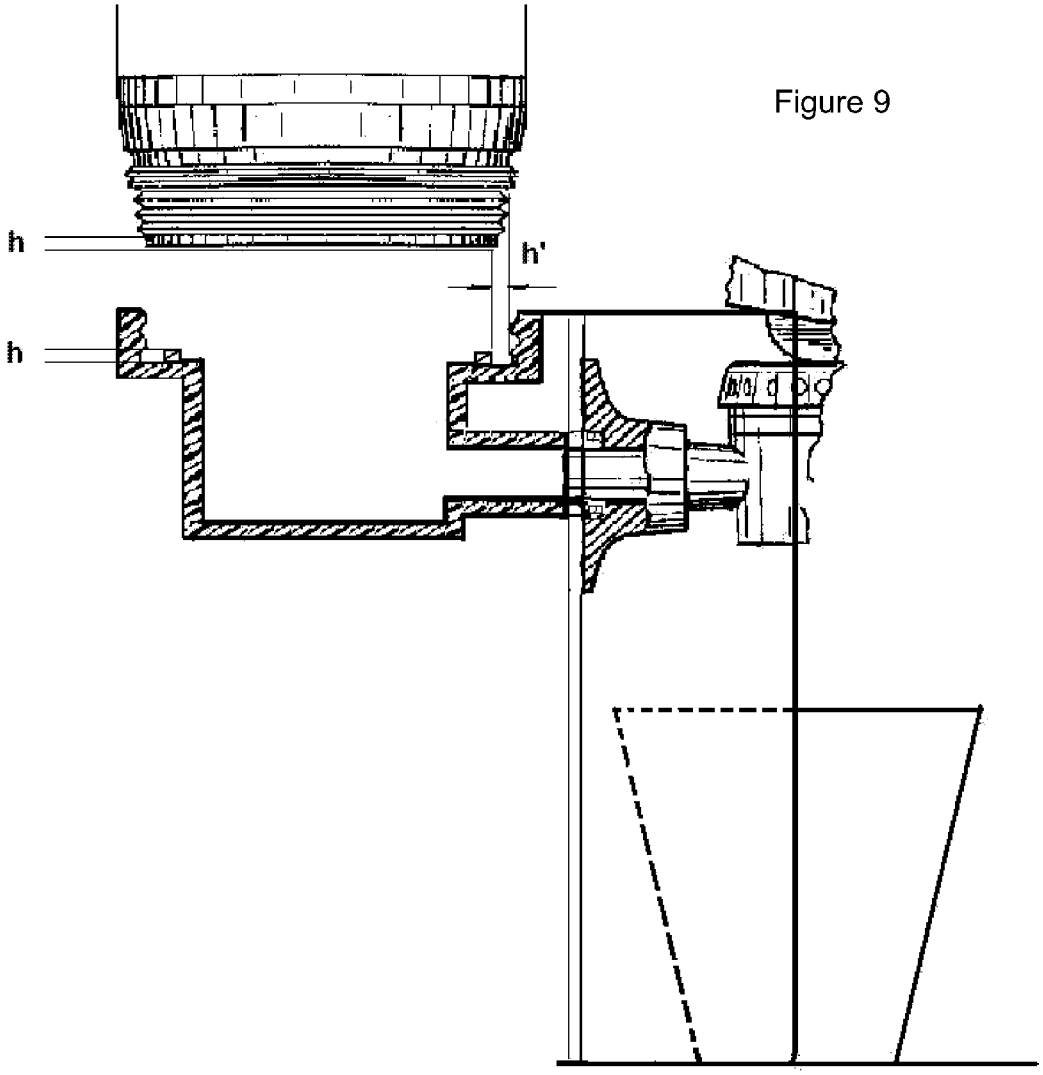
FIG. 9 shows a side view of the previous figure with a glass disposed under the tap.

FIG. 9 shows a side view of the previous figure, with a threaded receptacle or upper container and a neck of disposable bottle wherein distances h and h' are shown as in the previous figure; in this side view of part of the dispenser it can be observed that the receptacle or upper container is communicated with the tap by means of a side opening. This figure also shows a glass disposed inside a recess on the front wall aligned with the tap.

Figure 10:
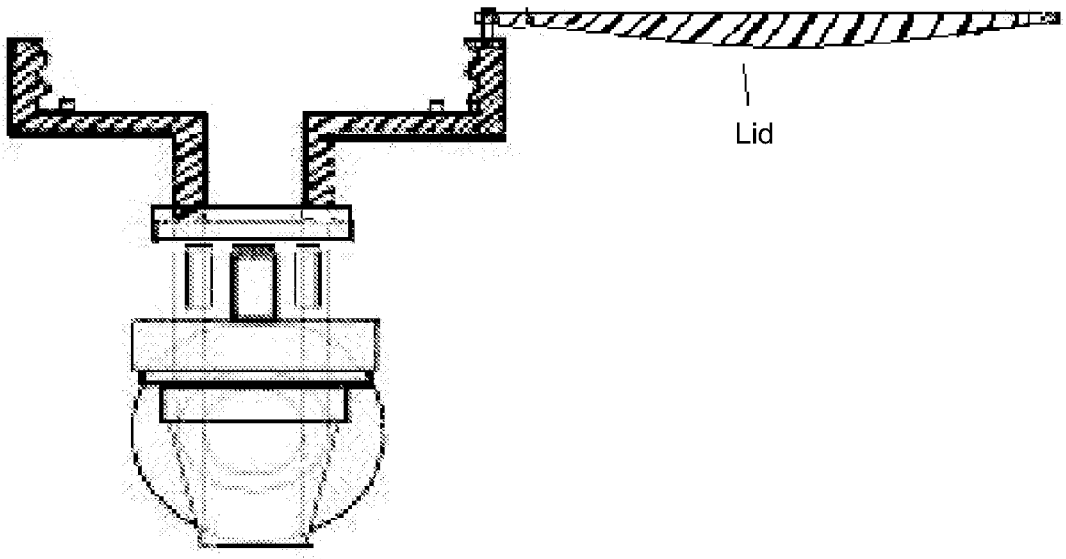
FIG. 10 shows a lid for the threaded receptacle or upper container.

FIG. 10 shows a lid with horizontal displacement that can be positioned on the upper container which has a larger diameter than the recess of the upper container where the disposable bottle engages. Said lid pivots on a pin inserted through the same and fixed on the side wall of the upper container; said wall can be formed with a suitable thickness to allow the insertion of the pin and said pin is inserted on the receptacle or upper container wall from the side the disposable bottle is threaded, that is perpendicular to the upper side of the housing.

The circular lid may be thicker on the center, decreasing towards its circumference; this larger thickness is located to the side where the upper container is closed which allows the same tightly engages on the upper edges of the upper container wall, while the lid surface is totally flat as seen from above.

Said lid is considered a security and hygiene means that prevents dirt particles from entering into the upper container when no bottle has been installed.

Figure 11:
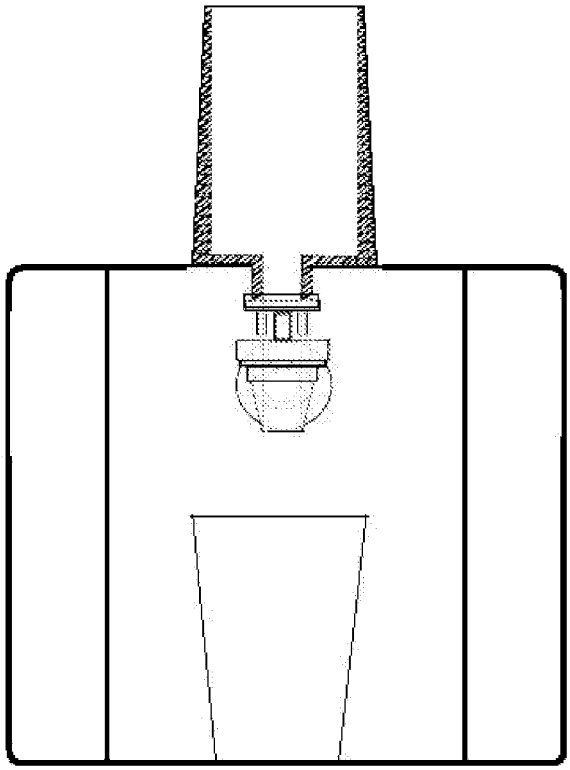
FIGS. 11 to 16 show the second embodiment of the invention wherein a hollow truncated cone as receptacle allows coupling the dispenser to different types of bottles with threaded caps or not.

FIG. 11 shows the other embodiment of the water dispenser with the upper truncated cone disposed on the housing and connected to the tap through a central orifice.

Figure 12:
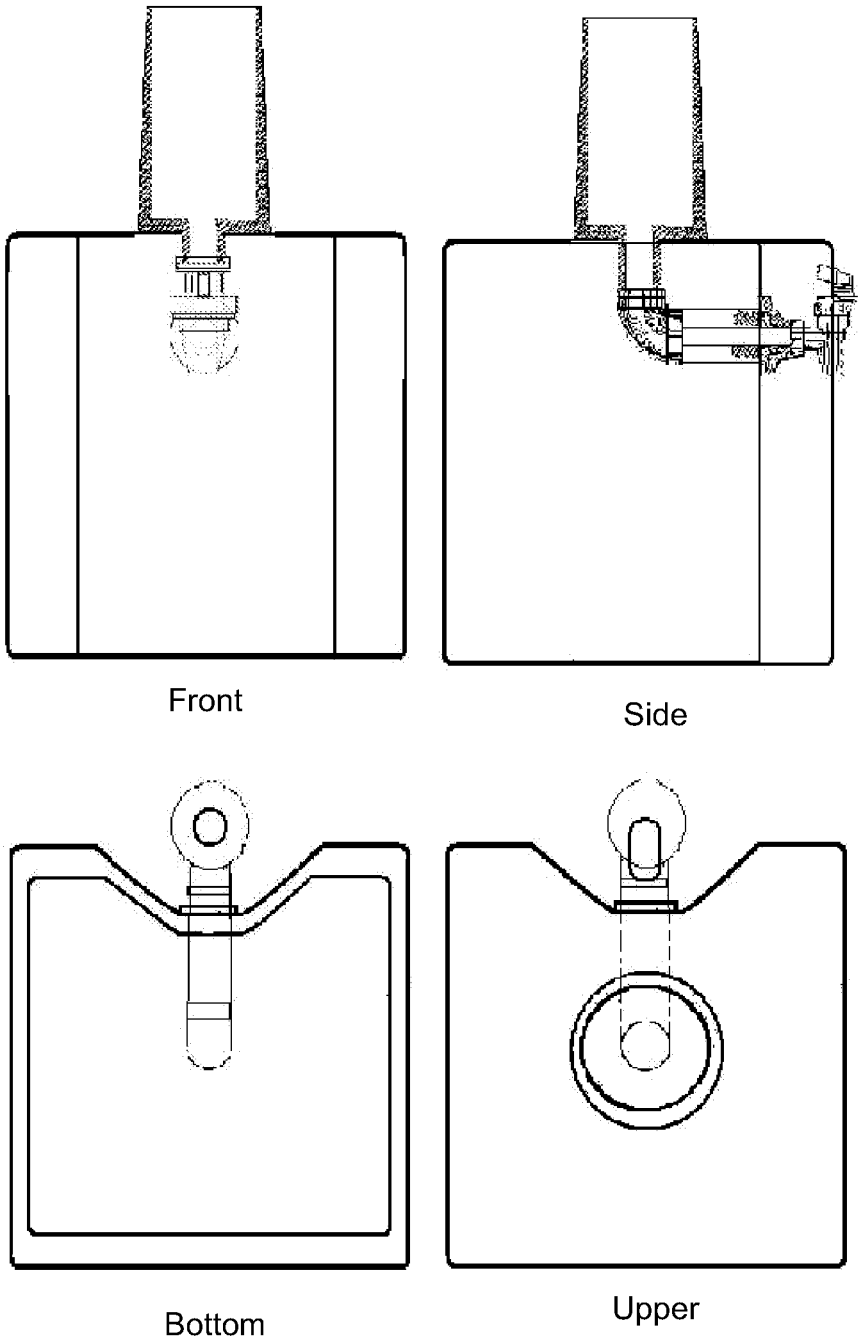

FIG. 12 shows a front, side, bottom, and upper view of the previous dispenser; in the side view the connection through the orifice of the initial section in the hollow truncated cone, this initial section connects with a 90° elbow, which is connected through a horizontal section with the tap. The bottom view allows to determine that this is a hollow housing supported on the ground by means of its side walls.

Figure 13:
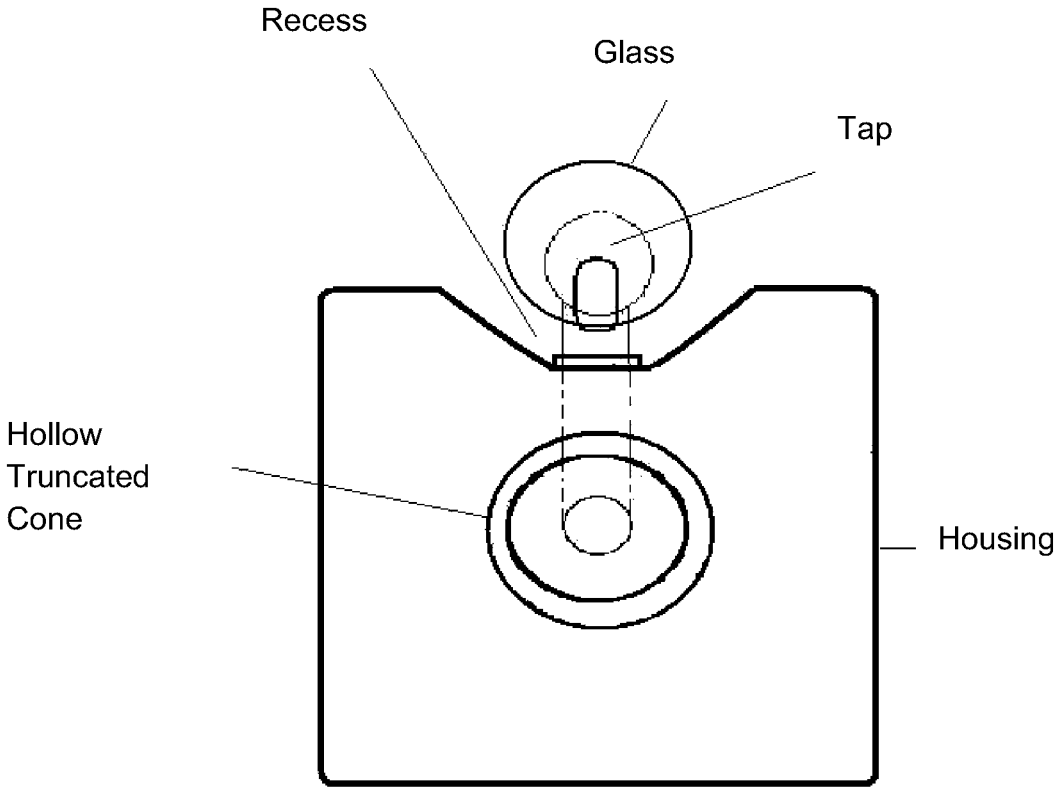

FIG. 13 shows an upper view of the water dispenser of the previous figure wherein a glass is disposed under the tap.

Figure 14:
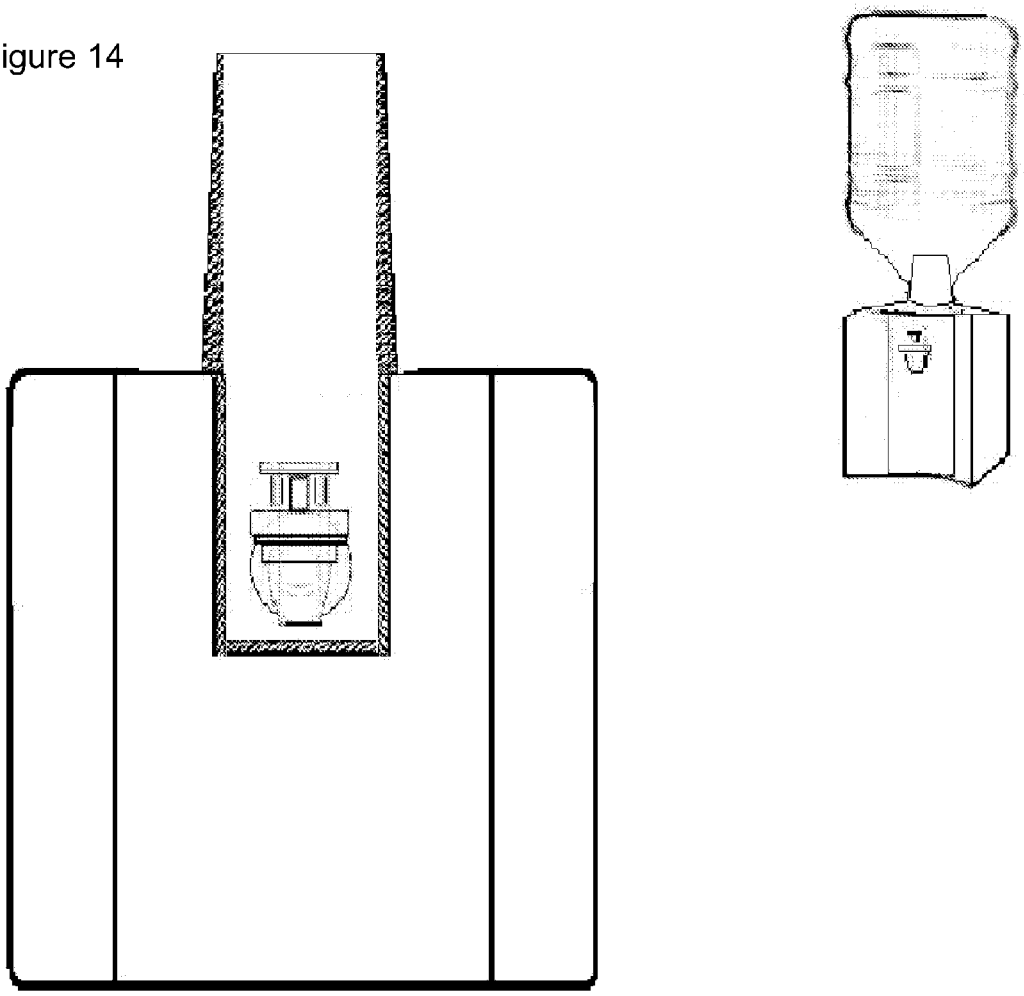

FIG. 14 shows a front view of the anti-bubbling and anti-contamination water dispenser wherein the hollow truncated cone is connected with a vertical initial section that has a diameter equal to the inner diameter of the major base of said hollow truncated cone and wherein the tap is threaded on the wall of this initial section from the front portion of the housing; it also shows perspective view of the same with a bottle attached to the hollow truncated cone.

Figure 15:
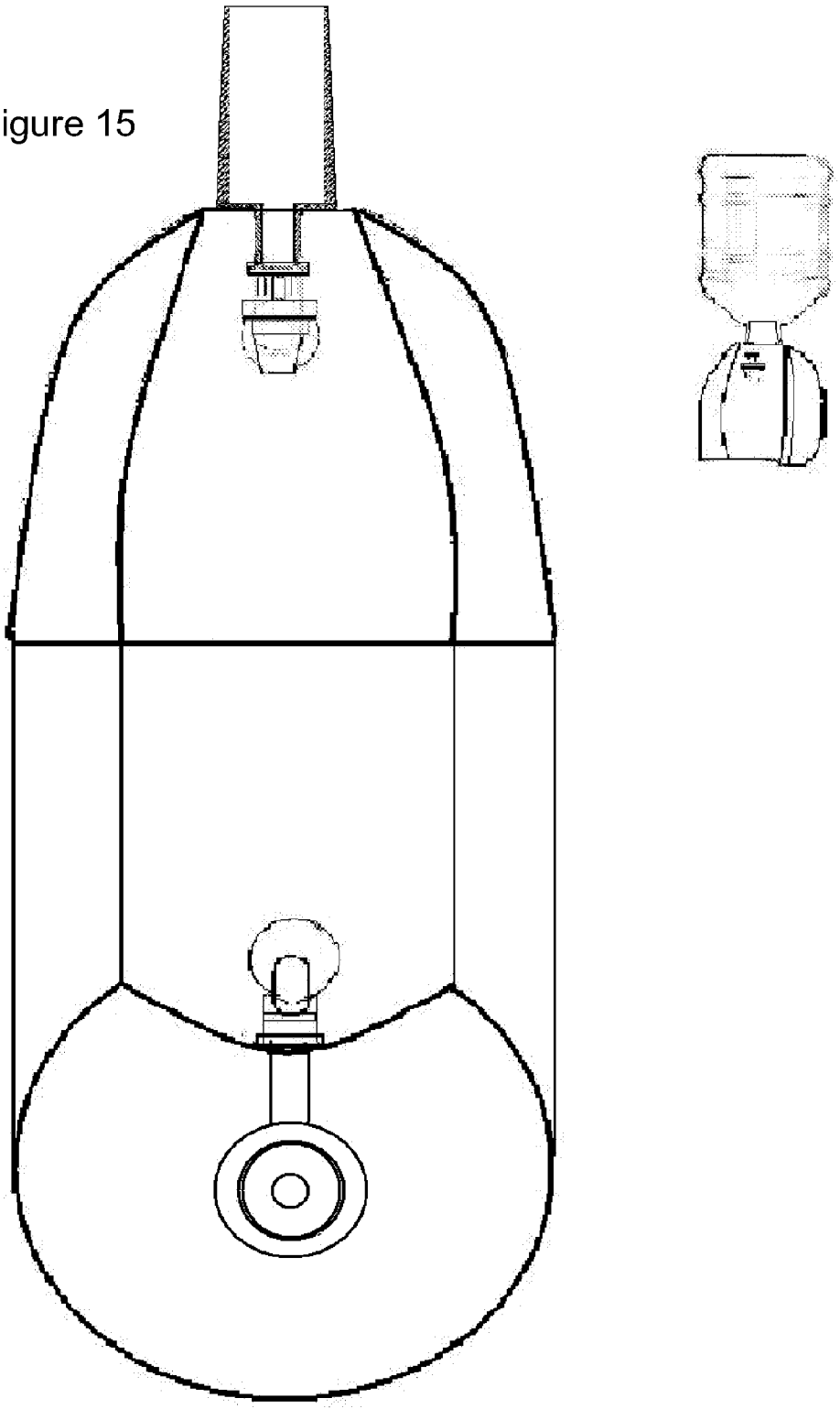

FIG. 15 shows a front and upper view of an anti-bubbling and anti-contamination water dispenser wherein the side walls are so curved that the dispenser has a circular shape if wasn't by the recess wherein the tap is disposed; in this case the hollow truncated cone projects from the upper wall of the housing which has a smaller surface than the support surface of the housing, also it shows a perspective view with the bottle attached to the hollow truncated cone of the container.

Figure 16:
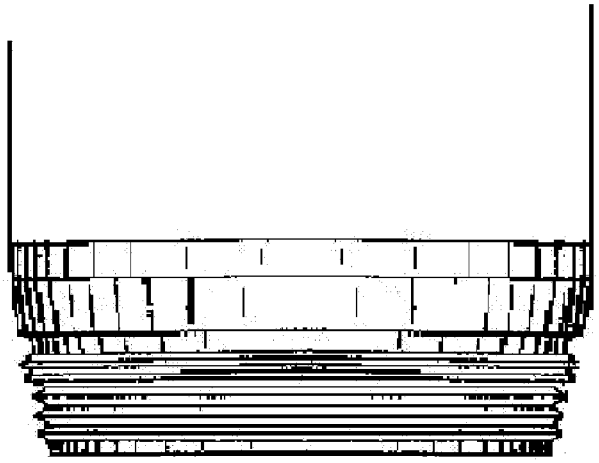
Figure 16:
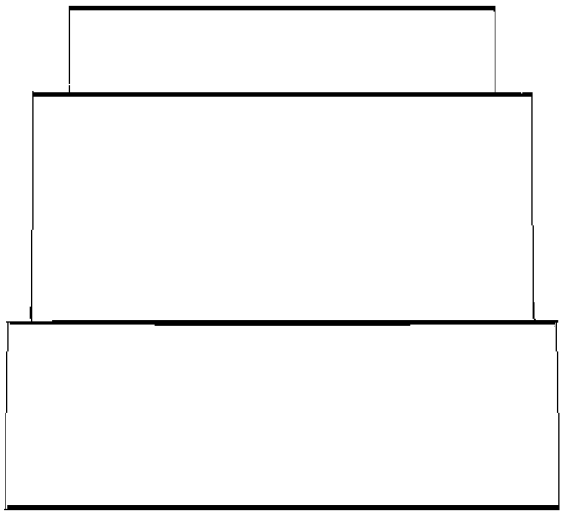
Figure 16:
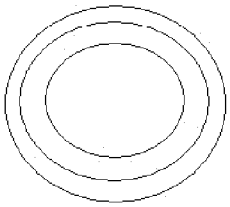

FIG. 16 shows a opening of bottle in this case with a threaded cap and the truncated cone with different steps, these steps may have the same slope but different diameters which allows to adapt the same to different bottles of different opening diameters.

The hollow truncated cone can be provided with a cap or top that is considered a security and hygiene means that prevents dirt particles from entering into hollow truncated cone when no bottle has been installed on the dispenser.

In this embodiment, the device of the present application comprises an anti-bubbling and anti-contamination water dispenser of the kind used to dispense water from water bottles, comprising a hexahedral housing to support said bottles, having on the upper wall hollow truncated cone that raises from said upper wall of the housing, wherein the slope of the hollow truncated cone decreases to the upper section comprising the upper minor base of the hollow truncated cone; said hollow truncated cone is joined to the housing by means of its bottom major base that is communicated with a tap to dispense water disposed perpendicular to the front wall of the housing to support said bottles; wherein said front wall of the housing to support said bottles has a recess that allows a gap between the tap outlet and the projection of said front wall wherein a glass for beverages aligned with the outlet center of water from the tap can fit, wherein said hollow truncated cone has in its upper minor base an outer diameter smaller than the inner diameter of the opening of the bottles.

In the anti-bubbling and anti-contamination water dispenser of the kind used to dispense water from bottles, comprising a hexahedral housing to support said bottles, having on the upper wall a hollow truncated cone, said hollow truncated cone is communicated with the tap by a central opening by means of a water circulation circuit comprising an initial vertical section and a 90° elbow allowing to connect it by means of a horizontal section to said tap.

In this anti-bubbling and anti-contamination water dispenser of the kind used to dispense water from bottles, comprising a hexahedral housing to support said disposable bottles, having on the upper wall hollow truncated cone, said hollow truncated cone is communicated with the tap by a lateral opening in the vertical initial section, wherein the inner diameter of the major base of the hollow truncated cone can be the equal to the inner diameter of the vertical initial section.

In this anti-bubbling and anti-contamination water dispenser of the kind used to dispense water from bottles, the hexahedral housing to support said disposable bottles can seat on any planar surface by means of the four side walls comprising the same.

Said support hexahedral housing can be hollow inside and may have curved side walls.

The base of the hexahedral housing to support said disposable bottles can have a larger area than the upper wall containing hollow truncated cone which has on its base a smaller outer diameter than the opening of the bottle. In the anti-bubbling and anti-contamination water dispenser of the kind used to dispense water from bottles, the water outlet height of the water tap is about 1.5 times the height of a glass for common beverages.

In the anti-bubbling and anti-contamination water dispenser of the kind used to dispense water from bottles, the hollow truncated cone can have steps with different diameters allowing adapting openings of different types of bottles of the market.

In the anti-bubbling and anti-contamination water dispenser of the kind used to dispense water from bottles, the housing cab be made of a plastic material that can be injected.

In the anti-bubbling and anti-contamination water dispenser of the kind used to dispense water from bottles, the hollow truncated cone, the initial section, the 90° elbow and the horizontal section are made in a single piece.

The hollow truncated cone can have a cap or top to prevent dirt deposits thereon when there is no bottle installed on the dispenser; said cap or top is inserted in the upper minor base of said hollow truncated cone.

It should be understood according to the preceding description of the present invention that the same is susceptible to changes, modifications and adaptations, and that said changes, modifications and adaptations fall within the scope of the appended claims.

What is claimed is:

1. An anti-bubbling and anti-contamination water dispenser used to dispense water from water bottles, comprising:

a hexahedral housing to support said bottles, said housing comprising a base, an upper wall, and a front wall therebetween;

a hollow truncated cone that raises from said upper wall, said hollow truncated cone, the cone having a height, an initial bottom section of the cone adjacent the upper wall of the housing having a first outside diameter so that a maximum outside diameter of the cone is less than half the height of the cone, an upper section of the cone having a smaller, second outside diameter, the exterior surface at each of plural locations along the height of the cone defining a different respective opening of a different type of water bottle, the housing supporting individual water bottles installed on hollow truncated cone, the bottom section defining a major base of said hollow truncated cone with the first outside diameter being smaller than a first inner diameter of an opening of bottles of a first type, the upper section defining a minor base of said hollow truncated cone with the second outside diameter being smaller than a second inner diameter of an opening of bottles of a second type, the second inner diameter being smaller than the first inner diameter, wherein a slope of the exterior surface of the hollow truncated cone decreases from the initial bottom section to the upper section and is one (1) degree, the bottom major base joining said hollow truncated cone to the housing;

a tap to dispense water in fluid communication with the bottom major base, the tap disposed perpendicular to the front wall of the housing, the tap having a tap outlet; and a recess located on the front wall, the recessing providing a gap between the tap outlet and a projection of said front wall wherein a glass for beverages aligned with the tap outlet can fit to receive water from the supported water bottle.

2. The anti-bubbling and anti-contamination water dispenser according to claim 1, wherein the hexahedral housing has curved side walls.

3. The anti-bubbling and anti-contamination water dispenser according to claim 1, wherein the base of the hexahedral housing has a larger area than an area of the upper wall.

4. The anti-bubbling and anti-contamination water dispenser according to claim 1, wherein the housing is made of an injectable plastic material.

5. The anti-bubbling and anti-contamination water dispenser according to claim 1, further comprising a cap fitting on the minor base to prevent dirt deposits thereon when there is no bottle installed on the dispenser.

6. The anti-bubbling and anti-contamination water dispenser according to claim 1, further comprising:

a water circulation circuit comprising an initial vertical section, a 90° elbow, and a horizontal section, the vertical section connecting to said bottom major base and the horizontal section connecting to said tap.

7. The anti-bubbling and anti-contamination water dispenser according to claim 6, wherein the hollow truncated cone, the housing, the vertical section, the 90° elbow, and the horizontal section are made as a single piece.

8. The anti-bubbling and anti-contamination water dispenser according to claim 6, further comprising:

a lateral opening in the vertical section.

9. The anti-bubbling and anti-contamination water dispenser according to claim 8, wherein an inner diameter of the major base is equal to an inner diameter of the vertical section.

10. The anti-bubbling and anti-contamination water dispenser according to claim 9, wherein the hexahedral housing is hollow.

* * * * *